US006540834B2

(12) United States Patent
Chingren

(10) Patent No.: US 6,540,834 B2
(45) Date of Patent: Apr. 1, 2003

(54) WALLPAPER DISPENSING APPARATUS

(76) Inventor: Misty Chingren, 1505 Osage Ct., Sioux City, IA (US) 51104

( * ) Notice: Subject to any disclaimer, the term of this patent is extended or adjusted under 35 U.S.C. 154(b) by 0 days.

(21) Appl. No.: 09/833,303

(22) Filed: Apr. 12, 2001

(65) Prior Publication Data

US 2001/0037762 A1 Nov. 8, 2001

Related U.S. Application Data

(60) Provisional application No. 60/197,155, filed on Apr. 13, 2000.

(51) Int. Cl.[7] ..... B05C 3/12

(52) U.S. Cl. ..... 118/419; 118/428

(58) Field of Search ..... 118/DIG. 17, 419, 118/413, 40, 43, 428, 429; 156/575; 222/81; 206/389

(56) References Cited

U.S. PATENT DOCUMENTS 360,373 A * 3/1887 Chester
3,368,522 A * 2/1968 Cordis
5,040,483 A 8/1991 Lieberman ..... 118/419
5,050,529 A * 9/1991 Pardeu ..... 118/419
5,336,323 A 8/1994 Cotton et al. ..... 118/428

* cited by examiner

*Primary Examiner*—Brenda A. Lamb
(74) *Attorney, Agent, or Firm*—Suiter & Associates PC

(57) ABSTRACT

A wallpaper dispensing apparatus includes a tray with a ridge projecting from the bottom and extending transversely between the side walls to divide the tray into a forward pool section and a rearward trough section. A removable cover is attached to the forward pool section and includes a pair of depressions with guide surfaces on the bottom, spaced above the bottom of the tray to form a passageway between the cover and tray bottom. the cover has a rearward portion following a portion of the ridge, and a straight rearward edge extending transversely across the tray. An opening in the cover, extending from the forward edge permits the user to draw a strip of wallpaper from a roll located in the trough, through the passageway between the cover and tray, and out the forward end of the tray. Water in the pool portion wets the wallpaper as it is drawn from the dispensing apparatus.

8 Claims, 1 Drawing Sheet

WALLPAPER DISPENSING APPARATUS

CROSS-REFERENCES TO RELATED APPLICATIONS

This application claims the benefit of U.S. Provisional Application Serial No. 60/197,155, filed Apr. 13, 2000.

STATEMENT AS TO RIGHTS TO INVENTIONS MADE UNDER FEDERALLY SPONSORED RESEARCH AND DEVELOPMENT (Not applicable)

BACKGROUND OF THE INVENTION (1) Field of the Invention

The present invention relates generally to apparatus for wetting prepasted wallpaper, and more particularly to an improved wallpaper dispensing apparatus for wetting, measuring, cutting, and otherwise preparing a strip of prepasted wallpaper for application to a wall.

(2) Background Information

Conventionally, noncommercial rolls of wallpaper are prepasted. More specially, paste is applied to the rearward face of wallpaper at the factory, and permitted to dry. The paper is then formed into a roll for sale.

The conventional method for wallpapering requires the user to first measure the wall, roll out a strip of wallpaper of an appropriate length and cut the strip. The rearward face of the wallpaper must then be wetted, in order to activate the glue or paste. Typically, the paper strip must be uniformly wetted with the glue in contact with water for a very short period of time, typically in the range of ten to twenty seconds. The paper is then generally folded over upon itself such that the prepasted faces are in contact, to activate the glue in a process known as "booking". The paper may then be installed on a wall, as desired.

There are several difficulties encountered when installing wallpaper. First, in order to cut the wallpaper strip to the appropriate length, the wallpaper roll must be unrolled, the remaining roll being restrained while the elongated strip is measured. It is then necessary to use a square, or other straightedge aligned perpendicular to the length of the strip at the appropriate location, and support the strip on a surface for cutting with a knife. In many cases, after cutting the paper, the user must reverse the roll of the paper in order to neutralize some of the "memory" which occurs in the paper by virtue of the paper being rolled at the factory.

The cut strip is then immersed as a roll or dipped in a conventional rectangular tray of water in an attempt to wet the rearward surface of the paper. The use of conventional rectangular trays for wetting the paper is convenient for space requirements, but does not necessarily provide a consistent and uniform result in wetting the adhesive over the length of the strip. The best results are obtained by contacting water to the prepasted face of the wallpaper for a uniform amount of time over the entire length of the wallpaper strip. Without this uniformity, poor adhesion can result and bubbles or separating edges may occur in the installed wallpaper.

The nonuniform wetting of the paper occurs as the rolled piece is immersed in the tray of water. A second person is typically required to hold the cut strip under the surface of the water as the strip is then slowly withdrawn. It can be seen that the immersed end of the paper remains under water for a much longer period of time than the end which is first withdrawn from the water.

BRIEF SUMMARY OF THE INVENTION

It is therefore a general object of the present invention to provide an improved wallpaper dispensing apparatus.

Another object is to provide a wallpaper dispensing apparatus which permits a single user to draw a strip of wallpaper through water to uniformly wet the strip.

A further object of the present invention is to provide a wallpaper dispensing apparatus which permits a strip of wallpaper to be cut at the desired length as part of the wetting procedure.

Yet another object is to provide a wallpaper dispensing apparatus which permits measurement and cutting of a length of wallpaper strip without assistance of a second person.

Still a further object of the present invention is to provide a wallpaper dispensing apparatus which is simple to use, refined in appearance, and economical to manufacture.

These and other objects will be apparent to those skilled in the art.

The wallpaper dispensing apparatus of the present invention includes a tray with a ridge projecting from the bottom and extending transversely between the side walls to divide the tray into a forward pool section and a rearward trough section. A removable cover is attached to the forward pool section and includes a pair of depressions with guide surfaces on the bottom, spaced above the bottom of the tray to form a passageway between the cover and tray bottom. The cover has a rearward portion following a portion of the ridge, and a straight rearward edge extending transversely across the tray. An opening in the cover, extending from the forward edge permits the user to draw a strip of wallpaper from a roll located in the trough, through the passageway between the cover and tray, and out the forward end of the tray. Water in the pool portion wets the wallpaper as it is drawn from the dispensing apparatus.

BRIEF DESCRIPTION OF THE SEVERAL VIEWS OF THE DRAWING

The preferred embodiment of the invention is illustrated in the accompanying drawings, in which similar or corresponding parts are identified with the same reference numeral throughout the several views, and in which.

DETAILED DESCRIPTION OF THE INVENTION

Figure 1:
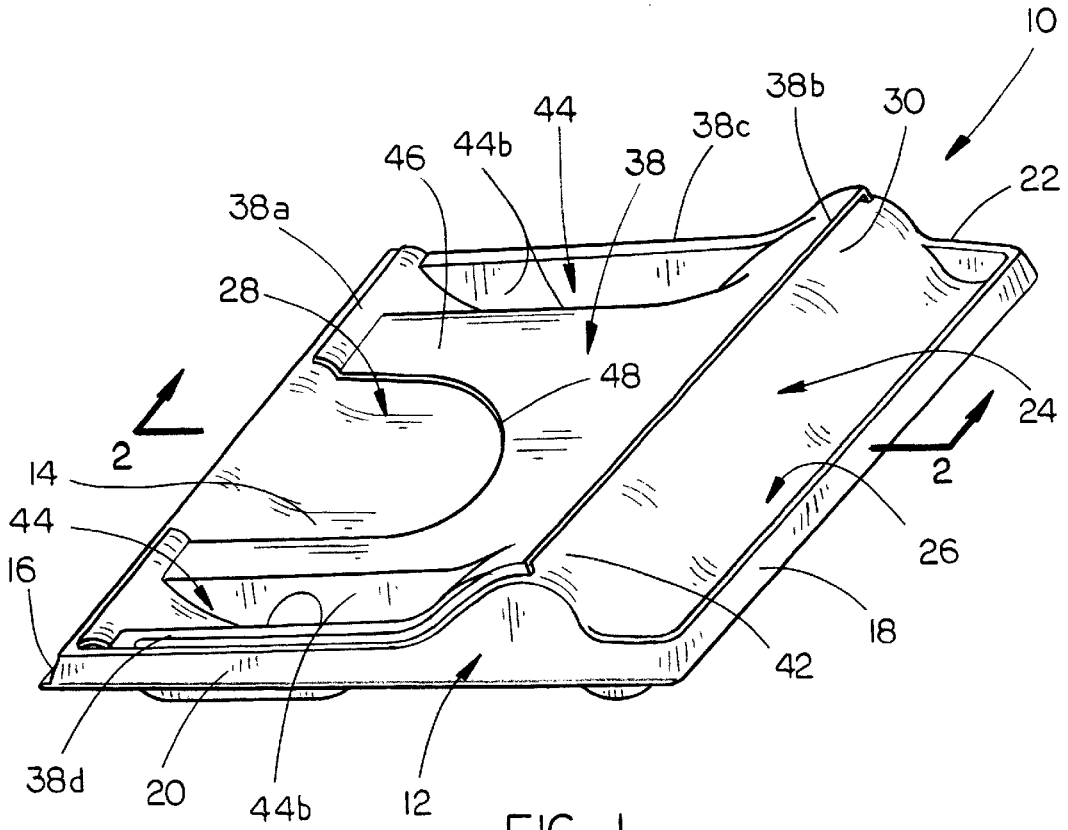
FIG. 1 is a perspective view of the wallpaper dispensing apparatus of the present invention.

Referring now to the drawings, and more particularly to FIG. 1, the wallpaper dispenser apparatus of the present invention is designated generally at 10 and includes a generally rectangular tray 12 having a bottom 14, forward and rearward end walls 16 and 18, and opposing longitudinal side walls 20 and 22.

A transverse ridge 24 is formed in the bottom 14, which projects upwardly beyond the height of side walls 20 and 22, and extends between side walls 20 and 22. It can be seen that ridge 24 separates tray 12 into a rearward trough 26 between ridge 24 and rearward wall 18, and a forward pool 28 extending from ridge 24 to forward wall 16.

Figure 2:
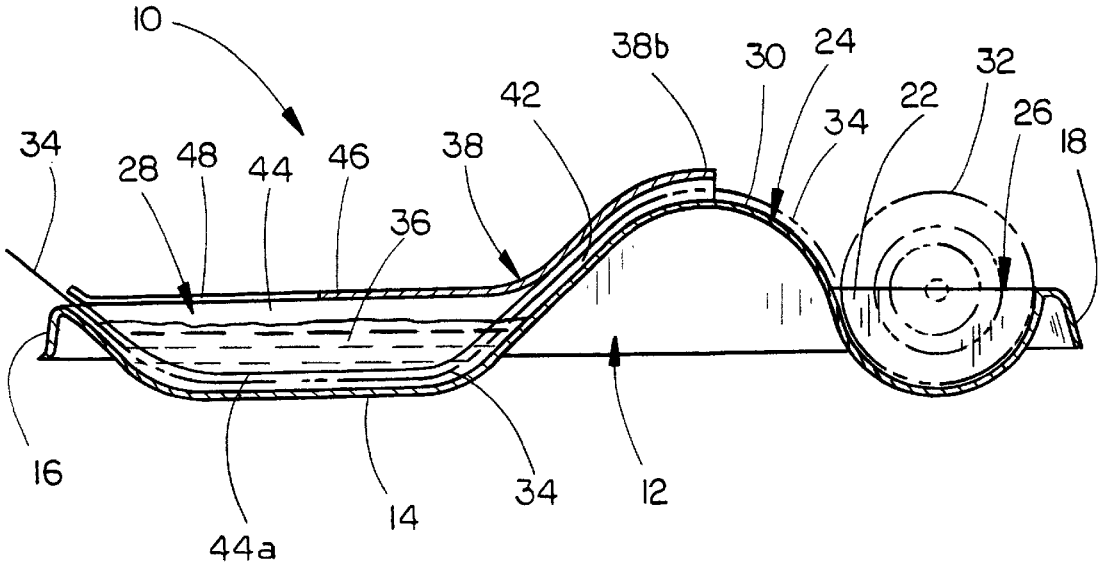
FIG. 2 is a sectional view taken at lines 2—2 in FIG. 1.

The upper surface 30 of ridge 24 is preferably curved to form a smooth connection with bottom 14, as shown in FIG. 2. Bottom 14 is also curved to assist in forming this smooth connection, and is also preferably curved at each end wall 16 and 18, to avoid sharp corners. Trough 26 is preferably semi-cylindrical in shape, to retain a roll 32 of wallpaper 34. The weight of the roll 32 maintains the roll within the trough as a wallpaper strip 34 is pulled from the roll 32.

Pool 28 is filled with water 36, as shown in FIG. 2, and wallpaper strip 34 is then dipped through the water 36 to wet the wallpaper as it is being drawn from roll 32. A cover 38 is mounted on tray 12 over pool 28, to assist in maintaining water 36 within the tray during the wetting process, and to guide the wallpaper strip 34 through water 36.

Cover 38 is a generally rectangular sheet of plastic material having forward and rearward edges 38*a* and 38*b*, and opposing side edges 38*c* and 38*d*. The rearward edge 38*b* of cover 38 is curved upwardly to follow the shape of the curvature of ridge 24, and the side edges 38*c* and 38*d* of the cover along ridge 24 have short side walls 40 spacing cover 38 parallel and above the surface 30 of ridge 24, to form a passageway 42 therebetween.

A pair of depressions 44 are formed in cover 38 adjacent each side edge 38*c* and 38*d*, and extend from ridge 24 to the forward edge 38*a* of cover 38. The bottom surface 44*a* of each depression 44 is spaced slightly away from the tray bottom 14 to continue passageway 42 from ridge 24 along the bottom of pool 28, thence to the forward end wall 16 of tray 12. The wallpaper strip 34 may then be pulled from pool 28 between the forward edge 38*a* of cover 38 and the forward end wall 16 of tray 12.

Depressions 44 are separated by an intermediate portion 46 of cover 38. A large arch-shaped opening 48 extends rearwardly from the forward edge 38*a* of cover 38, into intermediate portion 46. Opening 48 permits the user to pull the wallpaper strip 34 through the pool 28 and out the forward edge of tray 12.

As shown in FIG. 1, cover 38 has a width corresponding to the width of tray 12, with the side walls 44*b* of depressions 44 spaced a distance to form a tight fit between the side walls 20 and 22 of the tray. In this way, cover 38 is removable from tray 12 and is held in place by a friction fit between the side walls 44*b* of depressions 44 and the tray side walls.

The rearward edge 38*b* of cover 38 extends transversely between tray side walls 20 and 22, perpendicular to the length of the wallpaper strip 24. In this way, rearward edge 38*b* serves as a guide for cutting the wallpaper strip 34. The distance of travel of the wallpaper from rearward edge 38*b* of cover 38, under depression bottom walls 44*a*, to forward edge 38*a* is a known distance, preferably twelve inches, thereby permitting length of wallpaper to be measured as they are drawn from the wallpaper roll. Printed markings (not shown) may also be formed on cover 38, preferably along opening 48, for more precise measurements.

Whereas the invention has been shown and described in connection with the preferred embodiment thereof, many modifications, substitutions and additions may be made which are within the intended broad scope of the appended claims.

I claim:

1. A wallpaper dispensing apparatus, comprising:

a tray having forward and rearward walls, opposing side walls, and a bottom;

a ridge in the bottom extending transversely between the side walls and forming a pool between the ridge and forward wall, and forming a trough between the ridge and rearward wall; and a cover extending between the side walls and proximal the ridge and forward wall, said cover including a rearward portion generally parallel to a top surface of the ridge, and a rearward edge located generally centrally over the ridge, said cover forming a passageway between the cover rearward portion and ridge top surface for journaling a strip of wallpaper;

wherein said cover includes a pair of spaced apart, parallel guide surfaces extending from the rearward portion forwardly to a forward edge of the cover, extending generally parallel and spaced above the bottom to continue the passageway from the ridge to the tray forward end.

2. The wallpaper dispensing apparatus of claim 1, wherein said guide surfaces are formed on the bottom of a pair of depressions formed on the cover, with an intermediate portion of the cover extending between the depressions from the rearward portion of the cover to the cover forward edge.

3. The wallpaper dispensing apparatus of claim 2, wherein said cover intermediate portion has an opening formed therein extending rearwardly from the forward edge, permitting access to the pool of the tray.

4. The wallpaper dispensing apparatus of claim 1, wherein said cover rearward edge is straight, and extends perpendicularly to the side walls to form a straight cutting edge.

5. The wallpaper dispensing apparatus of claim 1, wherein said tough is generally semi-cylindrical in shape.

6. The wallpaper dispensing apparatus of claim 1, wherein said pool is suitable for holding water therein for wetting the strip of wallpaper.

7. The wallpaper dispensing apparatus of claim 1, wherein said cover is removably connected to the fray.

8. The wallpaper dispensing apparatus of claim 1, wherein said cover has a predetermined length, as measured from the rearward edge, through the passageway under the guide surfaces, to the forward edge.

* * * * *